US011348723B2

(12) United States Patent
Moon et al.

(10) Patent No.: US 11,348,723 B2
(45) **Date of Patent: *May 31, 2022**

(54) COIL COMPONENT

(71) Applicant: SAMSUNG ELECTRO-MECHANICS CO., LTD., Suwon-Si (KR)

(72) Inventors: Sung Min Moon, Suwon-Si (KR); Cheol Soon Kim, Suwon-Si (KR); Yu Jong Kim, Suwon-Si (KR); Dong Min Kim, Suwon-Si (KR); Young Do Choi, Suwon-Si (KR); Tae Ryung Hu, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 819 days.

This patent is subject to a terminal disclaimer.

(21) Appl. No.: 16/029,321

(22) Filed: Jul. 6, 2018

(65) Prior Publication Data

US 2019/0180927 A1 Jun. 13, 2019

(30) Foreign Application Priority Data

Dec. 11, 2017 (KR) ..... 10-2017-0169388

(51) Int. Cl.
*H01F 27/29* (2006.01)
*H01F 27/32* (2006.01)
(Continued)

(52) U.S. Cl.
CPC ..... *H01F 27/323* (2013.01); *H01F 17/0013* (2013.01); *H01F 27/2804* (2013.01);
(Continued)

(58) Field of Classification Search
CPC .... H01F 27/323; H01F 27/2804; H01F 27/29; H01F 2027/2809
(Continued)

(56) References Cited

U.S. PATENT DOCUMENTS 6,030,877 A * 2/2000 Lee ..... H01L 27/08 257/295
7,041,426 B2 * 5/2006 Eschbaumer ..... G03F 7/0046 430/908
(Continued)

FOREIGN PATENT DOCUMENTS

CN 103430256 A 12/2013
CN 105097186 A 11/2015
(Continued)

OTHER PUBLICATIONS

First Office Action issued in corresponding Chinese Patent Application No. 201811249971.4 dated Nov. 30, 2020, with English translation.

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

A coil component includes: a body including a support member including a through-hole, a first insulating layer supported by the support member and including a first opening portion, a second insulating layer disposed on the first insulating layer and including a second opening portion, and a coil including a coil pattern filled in the first and second opening portions; and external electrodes disposed on an outer surface of the body.

21 Claims, 4 Drawing Sheets

(51) Int. Cl.
*H01F 27/28* (2006.01)
*H01F 17/00* (2006.01)
*H01F 17/04* (2006.01)

(52) U.S. Cl.
CPC ..... *H01F 27/29* (2013.01); *H01F 27/292* (2013.01); *H01F 2017/048* (2013.01); *H01F 2027/2809* (2013.01)

(58) Field of Classification Search
USPC ..... 336/192
See application file for complete search history.

(56) References Cited

U.S. PATENT DOCUMENTS

| | | | | |
|---|---|---|---|---|
| 7,068,138 | B2 * | 6/2006 | Edelstein | H01L 23/5227 257/E21.022 |
| 7,253,489 | B2 * | 8/2007 | Na | G01R 33/05 257/421 |
| 7,389,576 | B2 * | 6/2008 | Na | G01R 33/05 310/179 |
| 8,048,704 | B2 * | 11/2011 | Smeys | H01L 28/10 257/421 |
| 8,410,576 | B2 * | 4/2013 | Smeys | H01L 23/5227 257/531 |
| 9,496,084 | B2 * | 11/2016 | Han | H01F 27/29 |
| 9,741,490 | B2 * | 8/2017 | Cha | H01F 41/042 |
| 9,899,136 | B2 * | 2/2018 | Lee | H01F 17/04 |
| 10,388,447 | B2 * | 8/2019 | Choi | H01F 5/00 |
| 10,636,554 | B2 * | 4/2020 | Choi | H01F 17/04 |
| 10,902,991 | B2 * | 1/2021 | Moon | H01F 27/292 |
| 10,984,942 | B2 * | 4/2021 | Kim | H01F 17/0013 |
| 2004/0164835 | A1 * | 8/2004 | Shoji | H01F 17/0013 336/200 |
| 2007/0247268 | A1 * | 10/2007 | Oya | H01L 23/3128 336/200 |
| 2011/0310579 | A1 * | 12/2011 | Smeys | H01F 17/04 361/782 |
| 2013/0278374 | A1 | 10/2013 | Thorslund | |
| 2015/0048918 | A1 * | 2/2015 | Park | H01F 17/0013 336/200 |
| 2015/0294789 | A1 | 10/2015 | Sano et al. | |
| 2015/0325510 | A1 | 11/2015 | Choi et al. | |
| 2016/0049235 | A1 | 2/2016 | Parish et al. | |
| 2016/0071643 | A1 | 3/2016 | Heo et al. | |
| 2017/0140866 | A1 | 5/2017 | Hong et al. | |
| 2017/0178789 | A1 | 6/2017 | Kim et al. | |
| 2017/0178798 | A1 | 6/2017 | Yoon et al. | |

FOREIGN PATENT DOCUMENTS

| | | | |
|---|---|---|---|
| CN | 205194481 | U | 4/2016 |
| CN | 106205973 | A | 12/2016 |
| CN | 106898479 | A | 6/2017 |
| CN | 107123505 | A | 9/2017 |
| DE | 103 23 099 | B4 | 8/2005 |
| JP | 2011-199080 | A | 10/2011 |
| JP | 2017017139 | A * | 1/2017 |
| KR | 10-1999-0066108 | A | 8/1999 |
| KR | 10-2015-0079935 | A | 7/2015 |
| KR | 10-2017-0060296 | A | 6/2017 |

* cited by examiner

COIL COMPONENT

CROSS-REFERENCE TO RELATED APPLICATION(S)

This application claims benefit of priority to Korean Patent Application No. 10-2017-0169388 filed on Dec. 11, 2017 in the Korean Intellectual Property Office, the disclosure of which is incorporated herein by reference in its entirety.

TECHNICAL FIELD

The present disclosure relates to a coil component, and more particularly, to a thin film type power inductor advantageous for high inductance and miniaturization.

BACKGROUND

In accordance with the development of information technology (IT), apparatuses have been rapidly miniaturized and thinned. Therefore, market demand for small, thin devices has increased.

Korean Patent Laid-Open Publication No. 10-1999-0066108 provides an a power inductor including a board having a via hole and coils disposed on both surfaces of the board and electrically connected to each other by the via hole of the board, in line with technical trends, thereby making an effort to provide an inductor including coils having an uniform and high aspect ratio.

SUMMARY

An aspect of the present disclosure may provide a coil component capable of simultaneously improving electrical characteristics such as Rdc characteristics, and the like, and reliability of a miniaturized inductor by allowing a coil pattern in the inductor to have a fine line width.

According to an aspect of the present disclosure, a coil component may include: a body including a support member including a through-hole, a first insulating layer supported by the support member and coming into contact with one surface or the other surface of the support member, a second insulating layer coming into contact with one surface or the other surface of the support member and including first and second opening portions, and a coil including a coil pattern filled between the first insulating layers and having a stacking layer composed of a plurality of layers; and external electrodes disposed on an outer surface of the body. The first opening portion may be filled with the first insulating layer, and the second opening portion may be filled with the coil pattern.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will be described in detail with reference to the accompanying drawings.

Hereinafter, a coil component according to an exemplary embodiment in the present disclosure will be described, but is not necessarily limited thereto.

Figure 1:
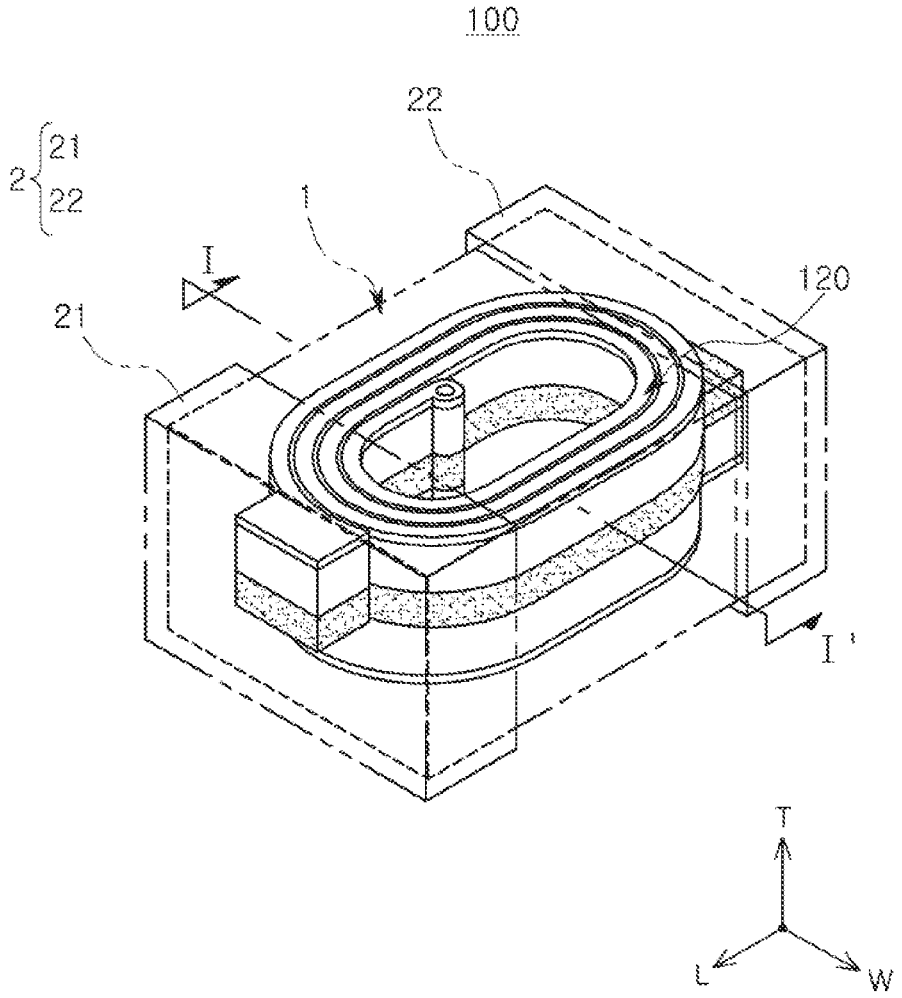
FIG. 1 is a perspective view of a coil component according to an exemplary embodiment in the present disclosure.
Figure 2:
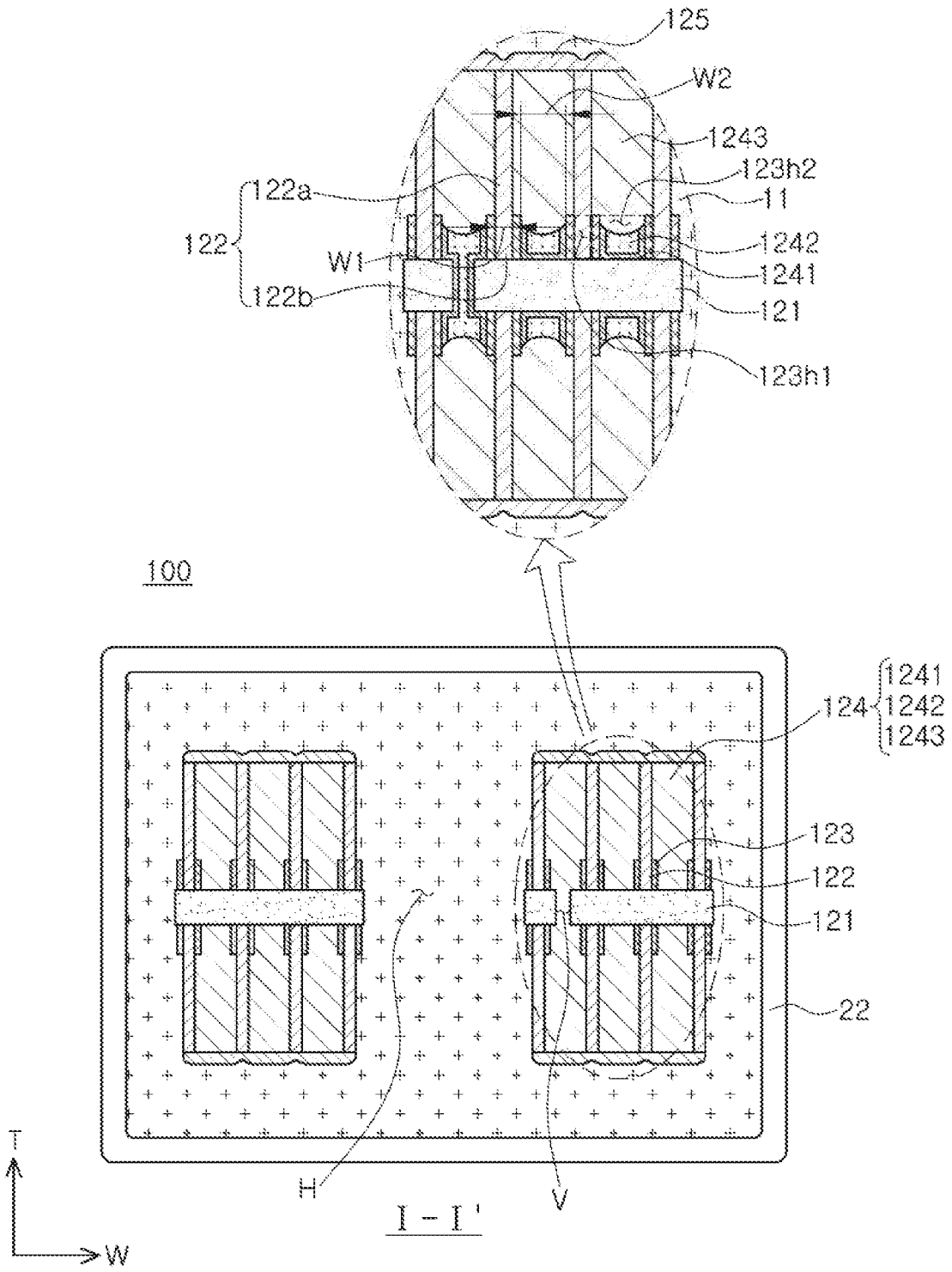
FIG. 2 is a cross-sectional view taken along line I-I' of FIG. 1.

FIG. 1 is a schematic perspective view of a coil component according to an exemplary embodiment in the present disclosure, and FIG. 2 is a cross-sectional view taken along line I-I' of FIG. 1.

Referring to FIGS. 1 and 2, a coil component 100 may include a body 1 and external electrodes 2. The external electrodes 2 may include first and second external electrodes 21 and 22 having different polarities from each other.

The body 1 may form an exterior of the coil component 100, have upper and lower surfaces opposing each other in a thickness (T) direction, first and second end surfaces opposing each other in a length (L) direction, and first and second side surfaces opposing each other in a width (W) direction, and have a substantially hexahedral shape.

The body 1 may contain a magnetic material 11 having magnetic properties, and the magnetic material may be suitably selected by those skilled in the art depending on purpose. For example, the magnetic material may be ferrite or a metal-resin composite material in which metal magnetic particles are dispersed in a resin.

A coil part 120 of the coil component 100 may be encapsulated by the magnetic material 11, and include a support member 121, first and second insulating layers 122 and 123 stacked on the support member 121, and a coil pattern 124.

The support member 121 may be an insulating substrate formed of an insulating resin. As the insulating resin, a thermosetting resin such as an epoxy resin, a thermoplastic resin such as polyimide, resins in which a reinforcement material, such as a glass fiber or an inorganic filler, is impregnated in the thermosetting resin and the thermoplastic resin, for example, a prepreg, an ajinomoto build-up film (ABF), FR-4, a bismaleimide triazine (BT) resin, a photo imageable dielectric (PID) resin, or the like, may be used. The support member 121 may have a thin thickness so that a thickness of the coil pattern 124 may be increased within a limited thickness of the coil component 100. For example, the thickness of the support member 121 may be about 10 μm or more to less than 60 μm.

The support member may include a through-hole H and a via hole V in the vicinity of the through-hole H. The through-hole may be filled with the magnetic material 11, and the via hole V may be filled with a conductive material. The reason is that the through-hole H is a space serving to enhance a magnetic flux generated by the coil, and the via hole V is a space serving to electrically connect upper and lower coil patterns on and below the support member 121 to each other.

The first insulating layer 122 may come in contact with one surface and the other surface of the support member 121. The first insulating layer 122 may be a configuration for insulating adjacent coil patterns from each other and serve as a plating growth guide in the plating growth of the coil pattern 124. The first insulating layer 122 may contain a permanent type photosensitive insulating resin. The reason may be that it is easy to laminate one or more sheet type insulating resin on the support member for forming the insulating layer and to pattern the laminated sheet type insulating resin so as to have a coil pattern with a desired shape using an exposure and development method. A line width and a thickness of the first insulating layer 122 may be suitably selected by those skilled in the art. However, in accordance with a high aspect ratio of the coil pattern, the first insulating layer 122 may have a thickness of preferably 100 μm or more to 300 μm or less, and in order to increase the number of turns of the coil pattern 124 within a limited size of the coil component 100, the line width of the first insulating layer 122 does not exceed 15 μm, and may be preferably greater than 5 μm in consideration of a process.

With respect to an upper surface of the second insulating layer 123, the first insulating layer 122 may be divided into a support portion 122*b* at a position equal to or lower than the upper surface of the second insulating layer 123 and a partition portion 122*a* at a position higher than the upper surface of the second insulating layer 123. The support portion 122*b* and the partition portion 122*a* may be only divided by the positions thereof based on the upper surface of the second insulating layer, but actually, the support portion 122*b* and the partition portion 122*a* may be formed of the same material, such that a separate boundary surface between the support portion 122*b* and the partition portion 122*a* is not necessarily observed.

The support portion 122*b* may entirely fill a first opening portion 123*h*1 of the second insulating layer 123, and substantially have a structure in which the support portion 122*b* is inserted into the first opening portion 123*h*1 of the second insulating layer 123.

In FIG. 2, a line width W1 of the support portion 122*b* and a line width W2 of the partition portion 122*a* may be substantially equal to each other. Although not illustrated, in some cases, a portion of which a line width is relatively thick may be formed in a boundary between the support portion 122*b* and the partition portion 122*a*, which is determined by those skilled in the art in a process, but is not essential.

The second insulating layer 123 may be disposed at both side surfaces of the support portion of the first insulating layer. The second insulating layer 123 may be supported by the support member 121, and serve to support the first insulating layer 122. Here, the second insulating layer 123 may support the first insulating layer 122, which means that the second insulating layer 123 may stabilize disposition of the first insulating layer 122 so as to prevent a problem that the first insulating layer 122 is leaned or delaminated from the support member 121 from occurring during a process or in use. As described above, since the first insulating layer 122 has a relative high aspect ratio, the first insulating layer 122 is not stably supported by the support member 121, such that a problem such as leaning, warpage, or delamination, or the like, may occur. In this case, if the first insulating layer 122 does not serve to suitably insulate adjacent coil patterns from each other, a short-circuit defect of the coil pattern may occur. However, in the coil component 100 according to the present disclosure, since both side surfaces of the support portion 122*b* of the first insulating layer 122 come in contact with the second insulating layer 123, the problem such as leaning, warpage, or delamination of the first insulating layer may be decreased.

Since the second insulating layer 123 serves to assist in stably supporting the first insulating layer 122 on the support member 121 and to expand a contact area between the support member 121 and the first insulating layer 122, the second insulating layer 123 may be formed of an insulating resin having insulation properties.

The second insulating layer 123 may include the first opening portion 123*h*1 for inserting the support portion 122*b* of the first insulating layer 122 and a second opening portion 123*h*2 for filling the coil pattern 124. Both of the first and second opening portions 123*h*1 and 123*h*2 may have a shape corresponding to an entire shape of the coil pattern 124, for example, a spiral shape formed by winding circles with different radii of curvature from each other several times.

A width of the first opening portion 123*h*1 may be substantially equal to the line width of the first insulating layer 122, and the second opening 123*h*2 may be formed to have a width narrower than that of the coil pattern 124.

Meanwhile, angles between the side surfaces of the first and second opening portions 123*h*1 and 123*h*2 and one surface or the other surface of the support member 121 may be suitably selected by those skilled in the art. Considering that the first insulating layer 122 is filled in the first opening portion 123*h*1 and a conductive material is filled in the second opening portion 123*h*2, the opening portions 123*h*1 and 123*h*2 may be formed to have a line width decreased in a direction toward the support member 121.

Therefore, as a material of the second insulating layer 123, any material may be used without limitation as long as it has insulation properties and a suitable level of rigidity, but there is a need to form the first and second opening portions 123*h*1 and 123*h*2 in the second insulating layer 123, a material having excellent processability as well as insulation properties may be preferably selected. For example, the second insulating layer 123 may be formed of a PID resin or ABF film. In this case, in order to relatively increase the thickness of the coil pattern 124 and a thickness of the magnetic material 11 encapsulating the coil pattern 124 within the entire thickness of the coil component 200, the second insulating layer 123 may be formed to have a thin thickness, for example, about 5 μm or more to 20 μm or less, but is not limited thereto.

The coil pattern 124 filled between adjacent first insulating layers 122 and in the second opening portion 123*h*1 of the second insulating layer 123 may have a T-shaped cross section of which a line width of a lower surface is narrower than that of an upper surface. The reason is that a lower portion of the coil pattern is filled between the second insulating layers 123 and an upper portion of the coil pattern is filled between the first insulating layers 122, but since the second insulating layer 123 is the insulating layer supporting both side surfaces of the first insulating layer 122, a width between adjacent second insulating layers 123 is narrower than that of adjacent first insulating layers 122.

The coil pattern 124 may have a stacking structure composed of plurality of layers. All the plurality of layers included in the coil pattern may contain a conductive material. A lowermost layer of the coil pattern 124 coming into contact with the support member may be a thin film conductor layer 1241. In this case, the thin film conductor layer 1241 may come in contact with at least a portion of the side surface of the second insulating layer 123 and an entire lower surface of the opening portion of the second insulating layer 123. A method of forming the thin film conductor layer 1241 is not limited, but for convenience of a process, a chemical copper plating method may be preferably used. More specifically, a method of remaining only a shape of the thin film conductor layer using etching after preparing a support member on which a second insulating layer having a predetermined opening portion (corresponding to the second opening portion) is disposed and performing the chemical copper plating on an entire exposed surface of the support member may be adopted, but the method of forming the thin film conductor layer 1241 is not limited thereto.

Since the thin film conductor layer 1241 is continuously formed on the side surfaces of the second insulating layer 123 opposing each other and the upper surface of the support member 121 continuously connected thereto, there is no risk that a void of the coil pattern 124 will be generated in edge portions formed by the second insulating layer 123 and the support member 121.

As a material of the thin film conductor layer 1241, any material may be used as long as it has excellent electrical conductivity. For example, the thin film conductor layer may contain Cu.

An exposed surface of the thin film conductor layer 1241 may be enclosed by a base layer 1242 of the coil pattern 124. Here, the exposed surface may mean a surface of the thin film conductor layer 1241 that does not come in contact with the second insulating layer 123 or the support member 121. A material of the base layer 1242 may be the same as or different from that of the thin film conductor layer 1241. That is, the material of the base layer 1242 may be suitably selected by those skilled in the art as long as it has excellent electrical conductivity.

An upper surface of the base layer 1242 may be a surface of which etching treatment is completed. That is, for convenience of the process, after plating for the base layer is performed at a thickness thicker than a thickness to be required, an upper portion of a plating layer for the base layer may be etched so that a short-circuit between adjacent coil patterns may be prevented. However, at the time of plating the base layer 1242, when the plating is performed by those skilled in the art at a thickness at which a short-circuit between adjacent base layers does not occur, there is no need to perform a separate etching treatment.

The base layer 1242 may substantially serve as a seed layer for a plating layer 1243 of the coil pattern 124 disposed thereon.

Meanwhile, the via hole V in the support member 121 of the coil component 100 may be filled with the thin film conductor layer 1241 and the base layer 1242. The thin film conductor layer 1241 may be disposed in the vicinity of the via hole V to be connected up to an entire inner side surface of the via hole V, and the upper and lower surfaces of the support member 121 connected to the via hole V. The base layer 1242 may fill a region of the via hole V including a central portion of the via hole V, that is not filled with the thin film conductor layer 1241. Reliability of a via may be improved by structures of the thin film conductor layer 1241 and the base layer 1242 filled in the via hole V. In some cases, after generally filling a Cu material in a via hole, a separate coating layer may be disposed on upper and lower surfaces of the via hole. However, in this case, delamination between the via and the coating layer connected thereto may occur. However, since in the coil component 100, only one kind of base layer 1242 is formed up to a region penetrating through the via hole V and upper and lower regions extending therefrom, there is no risk that a problem such as the above-mentioned delamination, or the like, will occur.

The plating layer 1243 may be disposed on the base layer 1242, and an aspect ratio of the coil pattern 124 may be substantially determined by an aspect ratio of the plating layer 1243. Since the plating layer 1243 is disposed between adjacent first insulating layers 122, and grows using the first insulating layer 122 as a guide, when the plating layer 1243 grows in the thickness direction, growth of the plating layer 1243 in the width direction may be effectively controlled, such that the aspect ratio of the coil pattern 124 may be stably increased.

The plating layer 1243 may grow up to a position equal to or lower than an upper surface of the first insulating layer 122. The reason is that when an upper surface of the plating layer is higher than the upper surface of the first insulating layer, a risk that a short-circuit between adjacent coil patterns will occur may be increased.

A third insulating layer 125 may be further disposed on the upper surface of the plating layer 1243 in order to insulate the coil pattern 124 and an encapsulant such as the magnetic material 11 encapsulating the coil pattern 124 from each other. A thickness of the third insulating layer 125 is not limited as long as the third insulating layer 125 may perform the insulation function as described above, but the thickness of the third insulating layer 125 may be 1 μm or more to 30 μm or less. When the third insulating layer 125 has a nano-scaled thickness thinner than 1 μm, a risk that the third insulating layer 125 will be damaged in use or during a manufacturing process may be significantly increased, and there is a limitation in controlling uniformity of the thickness. On the contrary, the thickness of the third insulating layer 125 is thicker than 30 μm, which is disadvantageous in view of a high aspect ratio of the coil pattern and a high filling rate the magnetic material in a low-profile coil component.

Referring to FIG. 2, the third insulating layer 125 may have a shape of a laminated insulating sheet. The third insulating layer may be formed of an insulating resin or a magnetic resin having insulation properties, and since the third insulating layer 125 is a configuration for insulation between the coil pattern 124 and the magnetic material 11, a suitable thickness of the third insulating layer 125 may be set by those skilled in the art as needed. Both end portions of the third insulating layer 125 may be positioned on the same line as an innermost side surface of the second insulating layer 123 and an outermost side surface of the second insulating layer 123, but if necessary, at least one of both end portions of the third insulating layer 125 may be formed to further protrude than the innermost or outermost side surface of the second insulating layer 123.

Figure 3:
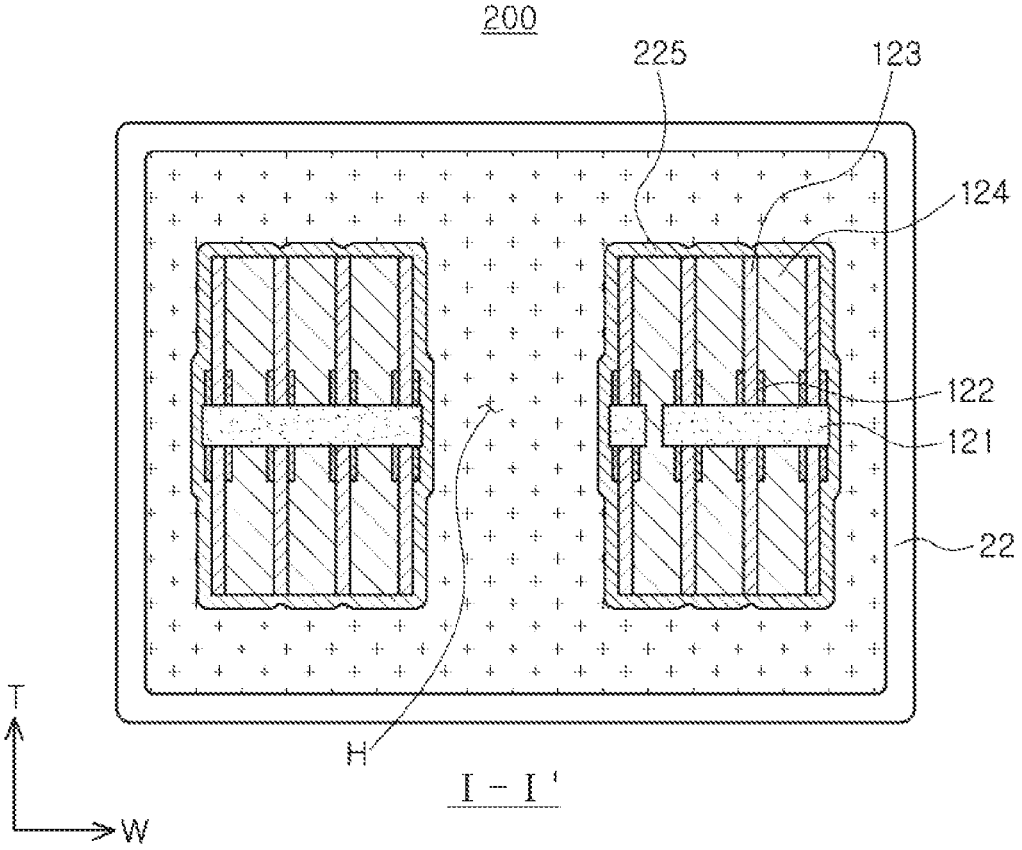
FIG. 3 is a cross sectional view of a first modified example of the coil component illustrated in FIGS. 1 and 2.

FIG. 3 is a cross sectional view of a coil component 200 according to a first modified example of the coil component illustrated in FIGS. 1 and 2. Since the coil component 200 of FIG. 3 is different from the coil component 100 of FIGS. 1 and 2 in view of a structure of a third insulating layer, the structure of the third insulating layer will be mainly described, and a technical description of overlapping configurations will be omitted.

Referring to FIG. 3, a third insulating layer 225 of the coil component 200 may be formed to enclose an outer side surface of an outermost second insulating layer as well as an upper surface of a coil pattern and an upper surface of a second insulating layer. This is to further strengthen insulation properties of the coil component, and a specific method of forming the third insulating layer 225 is not limited, but the third insulating layer 225 may be formed by chemical vapor deposition (CVD) of an insulating resin.

In addition, although not specifically illustrated, in order to increase a filling rate of a magnetic material in the center of a magnetic core, the third insulating layer may be formed to come in contact with an inner side surface of an innermost coil pattern without interposition of the second insulating layer after removing an innermost second insulating layer. In this case, a method of removing the innermost second insulating layer is not particularly limited, simultaneously with formation of a through-hole of a support member, the innermost second insulating layer adjacent to a through-hole may be removed.

A specific thickness of the third insulating layer 225 may be suitably selected by those skilled in the art. However, when the thickness is thinner than 1 μm, it may be difficult to control a nano-scaled insulating layer to be uniform in a process, and when the thickness of the third insulating layer 225 is thicker than 10 μm, a space in which the magnetic material may be filled may be decreased. Therefore, the thickness of the third insulating layer may be preferably 1 μm or more to 10 μm or less.

Figure 4:
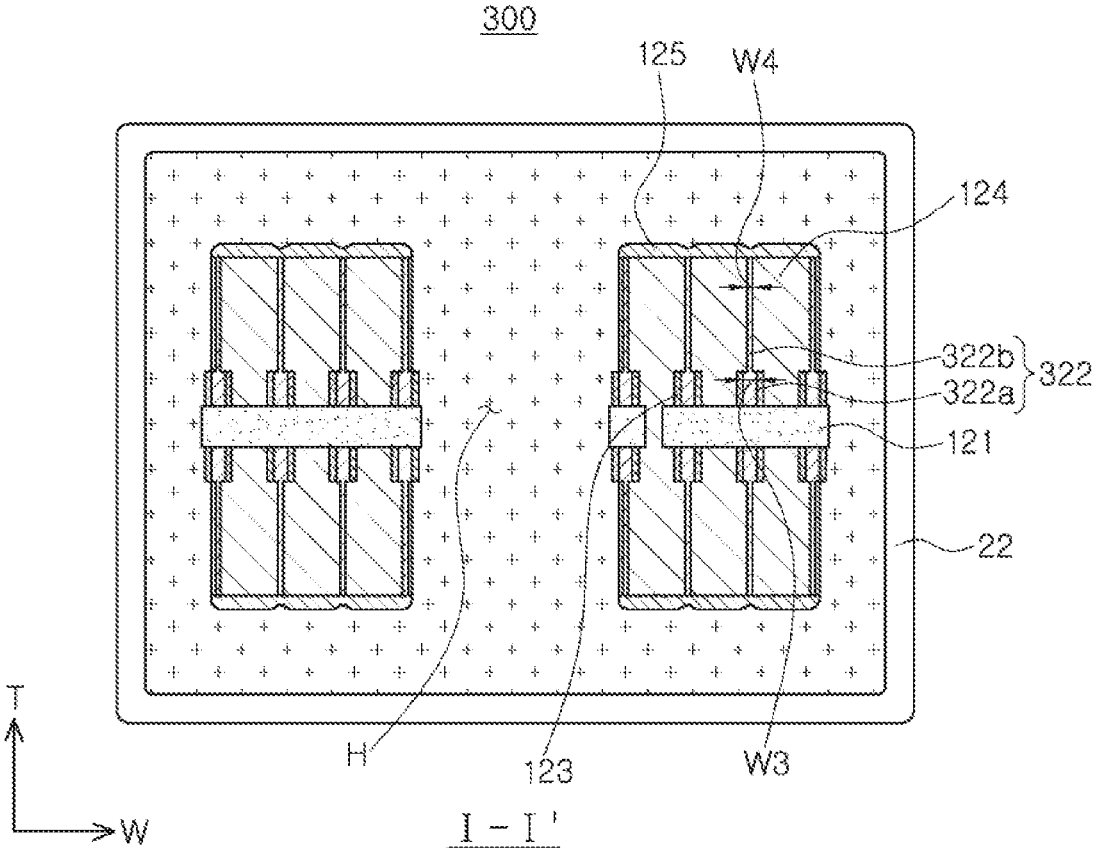
FIG. 4 is a cross sectional view of a second modified example of the coil component illustrated in FIGS. 1 and 2.

FIG. 4 is a cross sectional view of a coil component 300 according to a second modified example of the coil component illustrated in FIGS. 1 and 2. Since the coil component 300 of FIG. 4 is the same as the coil component 100 of FIGS. 1 and 2 except for a cross-sectional shape of a first insulating layer, the cross-sectional shape of the first insulating layer will be mainly described. In addition, for convenience of explanation, a detailed description of configurations of the coil component 300 overlapping those of the coil component 100 described above will be omitted.

Referring to FIG. 4, a support portion 322*a* and a partition portion 322*b* of a first insulating layer 322 and may have different line widths from each other. A line width w3 of the support portion 322*a* may be wider than a line width w4 of the partition portion 322*b*. The line width of the support portion 322*a* may be determined by a line width of a first opening portion of a second insulating layer, a first insulating layer having a higher aspect ratio may be provided by patterning the first insulating layer so that the line width of the partition portion 322*b* is thinner than that of the support portion 322*a*. Since as the aspect ratio of the first insulating layer is increased, stability of the first insulating layer supported by the support member is decreased, there is a limitation in increasing the aspect ratio of the first insulating layer. However, since stability of the first insulating layer supported by the support member may be sufficiently secured by allowing the support member of the first insulating layer supported by a second insulating layer to have a sufficient line width, the partition portion of the first insulating layer may be formed to have a thin line width, which is advantageous for securing a high aspect ratio. Further, a wider space between adjacent first insulating layers may be secured by allowing the partition portion of the first insulating layer to have a thin line width within a limited size of the coil component, such that the number of turns of the coil pattern may be increased.

As set forth above, according to exemplary embodiments in the present disclosure, the low-profile coil component including the coil pattern having a high aspect ratio may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a support member including a through-hole, a first insulating layer supported by the support member, a second insulating layer disposed on a side surface of the first insulating layer and including a first opening portion in which the first insulating layer is disposed, and a coil including a coil pattern filled in a second opening portion of the second insulating layer; and external electrodes disposed on an outer surface of the body, wherein the coil pattern has a T-shaped cross section of which a line width of a lower surface being in contact with the support member is narrower than that of an upper surface opposing the lower surface, and has a stacking structure comprising a plurality of layers, and the plurality of layers include a thin film conductor layer being in contact with the support member, the thin film conductor layer extending to an entire lower surface of the second opening portion and at least portions of both side surfaces of the second opening portion.

2. The coil component of claim 1, wherein the plurality of layers further include a base layer, and the base layer contains a conductive material and is disposed on the thin film conductor layer of the coil pattern.

3. The coil component of claim 2, wherein the base layer is embedded in the second opening portion of the second insulating layer.

4. The coil component of claim 1, wherein the support member further includes a via hole.

5. The coil component of claim 4, wherein both side surfaces of the via hole are entirely coated with the thin film conductor layer.

6. The coil component of claim 5, wherein the thin film conductor layer extends to portions of upper and lower surfaces of the support member connected to the via hole.

7. The coil component of claim 1, wherein a thickness of the support member is 10 μm or more to less than 60 μm.

8. The coil component of claim 1, wherein a thickness of the second insulating layer is 5 μm or more to 20 μm or less.

9. The coil component of claim 1, wherein a thickness of the first insulating layer is 100 μm or more to 300 μm or less.

10. The coil component of claim 1, wherein a line width of the first insulating layer is 5 μm or more to 15 μm or less.

11. The coil component of claim 1, wherein the body contains a magnetic material encapsulating the coil.

12. The coil component of claim 11, wherein the magnetic material is filled in the through-hole of the support member.

13. The coil component of claim 1, further comprising a third insulating layer disposed on an upper surface of the coil pattern.

14. The coil component of claim 13, wherein the third insulating layer has a shape of a sheet covering the upper surface of the coil pattern.

15. The coil component of claim 13, wherein the third insulating layer is a coating layer continuously covering the upper surface of the coil pattern and an upper surface of the second insulating layer, and at least a portion of one surface of the support member.

16. The coil component of claim 15, wherein a thickness of the third insulating layer is 1 μm or more to 10 μm or less.

17. The coil component of claim 1, wherein the second insulating layer extends from the support member and covers a portion of the first insulating layer.

18. The coil component of claim 17, wherein the portion of the first insulating layer covered by the second insulating layer has a line width the same as that of another portion of the first insulating layer not covered by the second insulating layer.

19. The coil component of claim 17, wherein the portion of the first insulating layer covered by the second insulating layer has a line width greater than that of another portion of the first insulating layer not covered by the second insulating layer.

20. A coil component comprising:

a body including a support member, first insulating layers extending from the support member, second insulating layers extending from the support member and respectively covering lower portions of the first insulating layers, and a coil pattern filling spaces between upper portions of the first insulating layers and spaces between the second insulating layers; and external electrodes disposed on an outer surface of the body and electrically connected to the coil pattern, wherein the coil pattern is in direct contact with the upper portions of the first insulating layers, and is spaced apart from the lower portions of the first insulating layers by the second insulating layers.

21. The coil component of claim 1, wherein the thin film conductor layer extends from the support member to a height lower than that of the second insulating layer.

* * * * *